US005873013A

United States Patent [19]

Matsushita et al.

[11] Patent Number: 5,873,013

[45] Date of Patent: Feb. 16, 1999

[54] IMAGE FORMING APPARATUS PROVIDED WITH CONTACT-TYPE CHARGER AND CONTROLLER FOR CLEANING CHARGER

[75] Inventors: Kouji Matsushita; Futoshi Okazaki, both of Toyokawa, Japan

[73] Assignee: Minolta Co., Ltd., Osaka, Japan

[21] Appl. No.: 997,812

[22] Filed: Dec. 24, 1997

[30] Foreign Application Priority Data

Dec. 29, 1996 [JP] Japan ..... 8-359180

[51] Int. Cl.[6] ..... G03G 15/02

[52] U.S. Cl. ..... 399/100; 399/174

[58] Field of Search ..... 399/100, 174, 399/50, 175, 176; 361/225, 226; 347/141, 149

[56] References Cited

U.S. PATENT DOCUMENTS

| | | | |
|---|---|---|---|
| 3,904,929 | 9/1975 | Kanaya et al. . | |
| 5,192,974 | 3/1993 | Ikegawa et al. . | |
| 5,278,614 | 1/1994 | Ikegawa et al. . | |
| 5,376,995 | 12/1994 | Yamamoto et al. . | |
| 5,402,213 | 3/1995 | Ikegawa et al. . | |
| 5,557,375 | 9/1996 | Nagayasu et al. | 399/174 |
| 5,572,293 | 11/1996 | Kikuchi et al. | 399/357 |
| 5,629,755 | 5/1997 | Ohtsuka | 399/176 |
| 5,655,188 | 8/1997 | Nagamori et al. | 399/174 |
| 5,697,020 | 12/1997 | Sato et al. | 399/100 |

FOREIGN PATENT DOCUMENTS

| | | |
|---|---|---|
| 57-048766 | 3/1982 | Japan . |
| 04051265 | 2/1992 | Japan . |
| 04051266 | 2/1992 | Japan . |
| 05-107882 | 4/1993 | Japan . |

*Primary Examiner*—Robert Beatty
*Attorney, Agent, or Firm*—McDermott, Will & Emery

[57] ABSTRACT

A charging member is disposed so as to contact a surface of a charge-receiving member which moves relative to the charging member. In conjunction with the movement of the charge receiving member, the charging member removes foreign substance present on the charge-receiving member on the upstream side in the direction of travel of the charge-receiving member at the contact region with the charging member. Simultaneously, a discharge voltage is applied to the charging member so that the charging member charges the charge-receiving member in the area from which said foreign substance has been removed at the contact region on the downstream side of the charge-receiving member in the direction of travel of the charge-receiving member. During a cleaning operation, the charging member retracts from the charge-receiving member and is out of contact therewith in accordance with the number of image formations, black and white ratio, and humidity. The removed foreign substance passes by said charging member in conjunction with the movement of the charge-receiving member.

20 Claims, 12 Drawing Sheets

IMAGE FORMING APPARATUS PROVIDED WITH CONTACT-TYPE CHARGER AND CONTROLLER FOR CLEANING CHARGER

BACKGROUND OF THE INVENTION

1. Field of the Invention

The present invention relates to a contact-type charger and an image forming apparatus provided with same.

2. Description of the Related Art

Conventional contact-type chargers used in copiers using electrophotographic methods have been proposed which use a polyurethane blade to remove residual charge remaining on the surface of a photosensitive member in preparation for a subsequent copy after a toner image formed on said photosensitive member has been transferred, such as the charger disclosed in Japanese Laid-Open Patent Application No. 57-48766.

Japanese Laid-Open Patent Application No. 49-72499 discloses art wherein a discharge sheet comprising a mix of carbon black and high molecular weight resin compound provided on a substrate cloth is used variously as clothing, carpet, wall covering, or industrially as an electrode in an electrostatic discharge device.

Japanese Laid-Open Patent Application No. 4-51265 discloses a contact-type charger that charges the surface of a photosensitive member by pressing a conductive member supported by a flexible member against said photosensitive member in an image forming apparatus.

Japanese Laid-Open Patent Application No. 4-51266 further discloses a contact-type charger that charges the surface of a photosensitive member via contact of a film-like charging member and the surface of said photosensitive member in an image forming apparatus.

These chargers all differ from typical corona-type chargers that charge a charge-receiving member such as a photosensitive member or the like via non-contact charging, inasmuch as charging is accomplished via contact between a charge-receiving member and a charging member formed of various materials in various configurations.

In contact-type chargers, foreign substance adhered to the surface of the charge-receiving member remains on a contact area due to the relative movement of the charge-receiving member and the charging member with keeping a contact state. Specifically, toner adhered to the surface of the photosensitive member remains on the contact area when charging is accomplished by devices that charge the photosensitive member via contact charger in image forming apparatuses of the electrophotographic type. In contact-type chargers, when foreign substance collects in the space formed between the charging member and charge-receiving member due to charging of the charge-receiving member via discharge, a suitable discharge cannot be generated such that the charge-receiving member cannot be uniformly charged, thereby producing uneven charging.

When a large amount of such foreign substance accumulates, the accumulated material overflows the local area and soils not only the charging device and charge-receiving member, but also the various peripheral components located nearby.

OBJECTS AND SUMMARY

In view of the aforesaid information, an object of the present invention is to provide an improved image forming apparatus, contact-type charger, and charging method.

A further object of the present invention is to provide an image forming apparatus, contact-type charger, and charging method having an excellent charging function.

A further object of the present invention is to provide an image forming apparatus, contact-type charger, and charging method which suppresses uneven charging caused by foreign substance accumulating between the charging member and the charge-receiving member.

A still further object of the present invention is to provide an image forming apparatus, contact-type charger, and charging method capable of collecting the accumulated foreign substance in the contact region.

These objects are attained by a charging device comprising:

a charging member disposed so as to contact the surface of a charge-receiving member, wherein said charge-receiving member moves relative to said charging member, such that the charging member removes foreign substance present on the charge-receiving member on the upstream side in the direction of travel of the charge-receiving member at the contact region with the charging member, and charges said charge-receiving member in the area from which said foreign substance has been removed at the contact region on the downstream side of the charge-receiving member in the direction of travel of the charge-receiving member; and means for making the removed foreign substance pass by said charging member in conjunction with the movement charge-receiving member.

BRIEF DESCRIPTION OF THE DRAWINGS

These and other objects and features of the present invention will become apparent from the following description of the preferred embodiments thereof taken in conjunction with the accompanying drawings, in which.

In the following description, like parts are designated by like reference numbers throughout the several drawings.

DETAILED DESCRIPTION OF THE PREFERRED EMBODIMENTS

Figure 1:
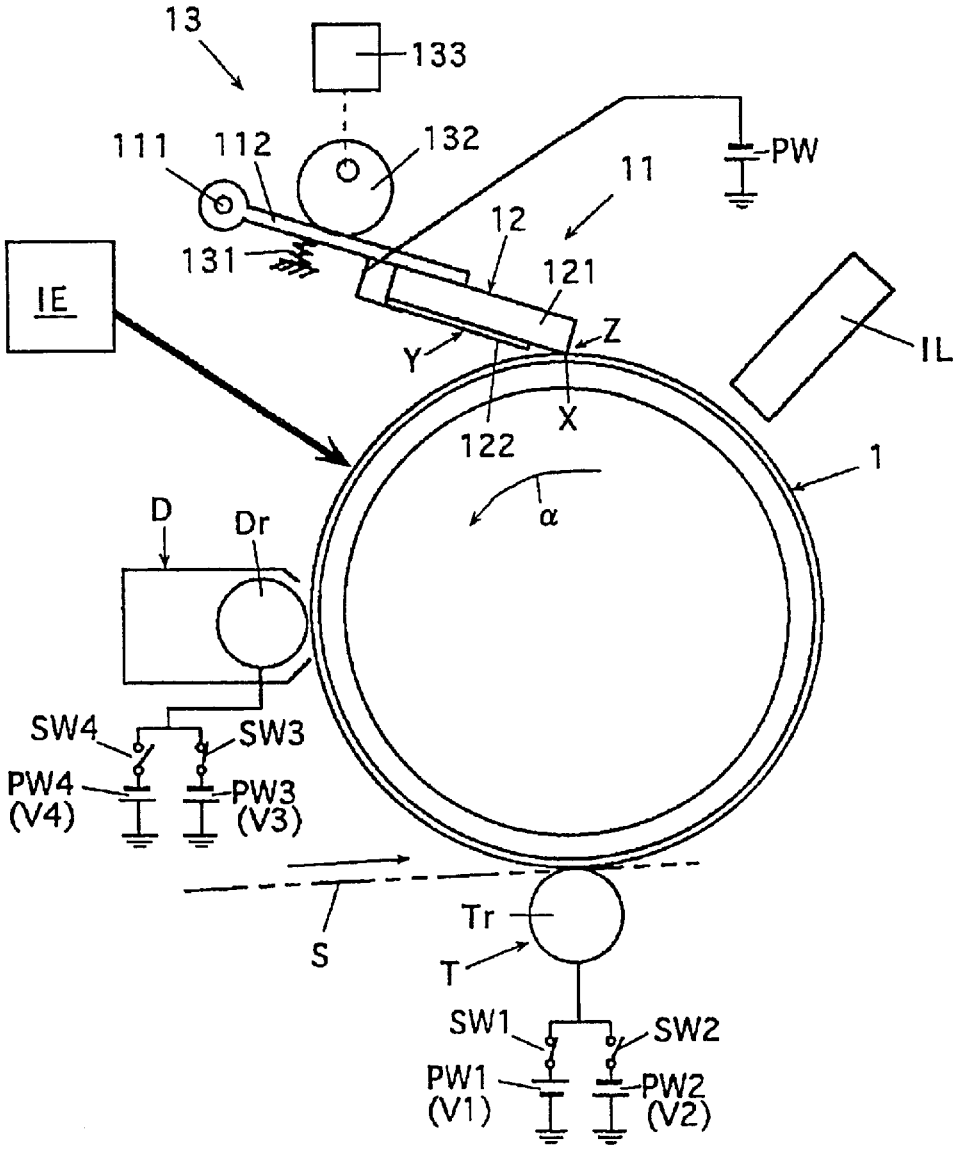
FIG. 1 briefly shows the construction of an image forming apparatus of the electrophotographic type provided with a contact charger.

FIG. 1 briefly shows the construction of an image forming apparatus of the electrophotographic type provided with a charging device.

Charger 11 is provided with a charging member 12 supported by a support arm 112, one end of which is capable of moving in rotation about a shaft 111. Charging member 12 comprises a blade 121 mounted on arm 112, and an electrode 122 mounted on the underside of said blade.

Figure 2:
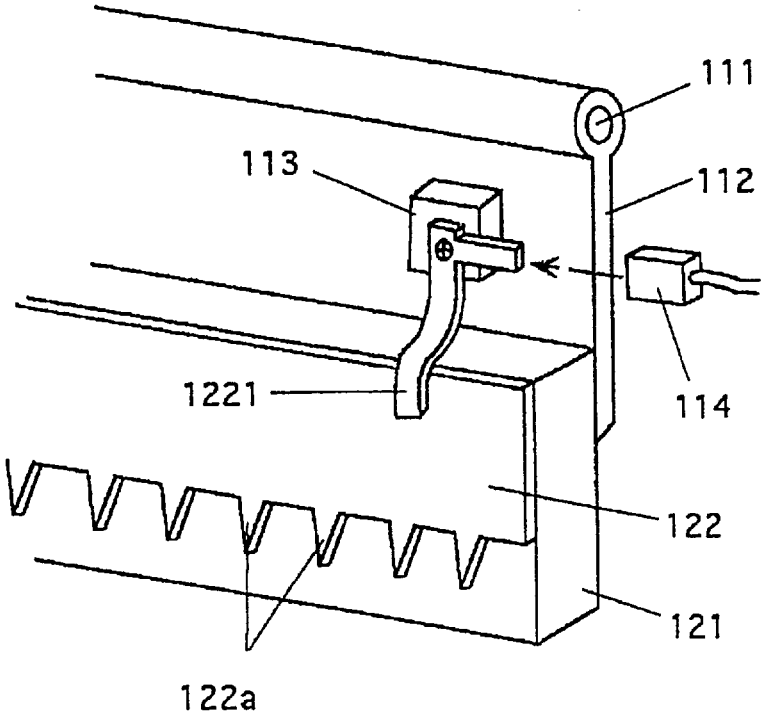
FIG. 2 is a perspective view of part of the charger of FIG. 1.

FIG. 2 is a perspective view of part of charger 11 viewed from below. As shown in FIG. 2, the tip of electrode 122 is formed as a sawtooth configuration 122*a*, so as to readily generate a discharge in the acute angle area of the tip. A comb-tooth configuration or the like may be used alternatively to said sawtooth configuration.

A connector electrode 1221 is provided on support arm 112 via an insulator 113 to prevent leaks, and this connector electrode 1221 is in contact with the electrode 122. The power unit PW shown in FIG. 1 is connected to the connector electrode 122 via a lead connector 114, so as to supply a predetermined voltage to electrode 122.

Charger 11 is used to charge the charge-receiving member, in this case photosensitive member 1, to a negative polarity. Photosensitive member 1 is a drum-shaped member driven in rotation in a counterclockwise direction $\alpha$ via a motor not shown in the drawing.

Arranged sequentially around the periphery of photosensitive member 1 in addition to charger 11 are, in a counterclockwise direction from charger 11, image exposure device IE, developing device D, transfer device T, and eraser IL to remove residual charge. This image forming apparatus is not provided with a cleaner between transfer device T and charger 11 to remove residual toner from the surface of the photosensitive member 1 after a toner image is transferred.

The underside angled edge of charging member 12 of charger 11 contacts the surface of photosensitive member 1, and removes foreign substance such as residual toner and the like adhered to the surface of the photosensitive member 1. Viewed from the direction of travel of photosensitive member 1, the location of initial contact between charging member 12 and photosensitive member 1 is designated initial contact position X in the following discussion. Removed foreign substance accumulates in the region on the upstream side of initial contact position X in the direction of travel of photosensitive member 1. This region is designated accumulation area Z in the following discussion. On the downstream side from the initial contact position X, the aforesaid electrode 122 which receives an applied discharge voltage is disposed opposite the photosensitive member 1 and charges the surface of said photosensitive member 1. In the following discussion, the location of charging member 12 inducing the electrode 122 used to charge photosensitive member 1 and which is disposed on the downstream side of the aforesaid initial contact position X of charging member 12 is designated the charging area Y.

A spring 131 is provided on the support arm 112 supporting the charging member 12 and acts to push said arm 112 from below, and an eccentric cam 132 is arranged in opposite to said spring to bring charging member 12 into contact with photosensitive member 1. In the state shown in FIG. 1, cam 132 pushes charging member 12 downward, such that the blade 121 of charging member 12 presses against photosensitive member 1. Cam 132 can be driven in rotation via a cam driving device 133 which includes a motor, such that the support arm is pushed by the spring 131 to cause the charging member 12 to retract from the photosensitive member 1 when cam 132 is rotated by said drive device 133 from the state sown in FIG. 1. In the retracted state, foreign substance accumulated in the aforesaid accumulation area Z passes between charging member 12 and photosensitive member 1 in conjunction with the rotation of said photosensitive member 1.

The support arm 112 may be driven by other methods such as the use of a solenoid.

The electrode 122 of charging member 12 is a discharge electrode, and receives a charging voltage from power unit PW.

The previously mentioned developing device D includes a developing roller Dr, which is connected to power unit PW3 via switch SW3 that supplies a developing bias voltage during image formation, and is connected to a power unit PW4 via switch SW4 during cleaning to collect foreign substance. The voltage V3 of power unit PW3 is higher than the voltage V4 of power unit PW4.

Transfer device T includes a transfer roller Tr, which is connected to power unit PW1 via switch SW1 that supplies a transfer voltage during image formation, and is connected to power unit PW2 via switch SW2 that supplies a voltage during cleaning which has a polarity that is opposite the polarity of the voltage during transfer.

Figure 3:
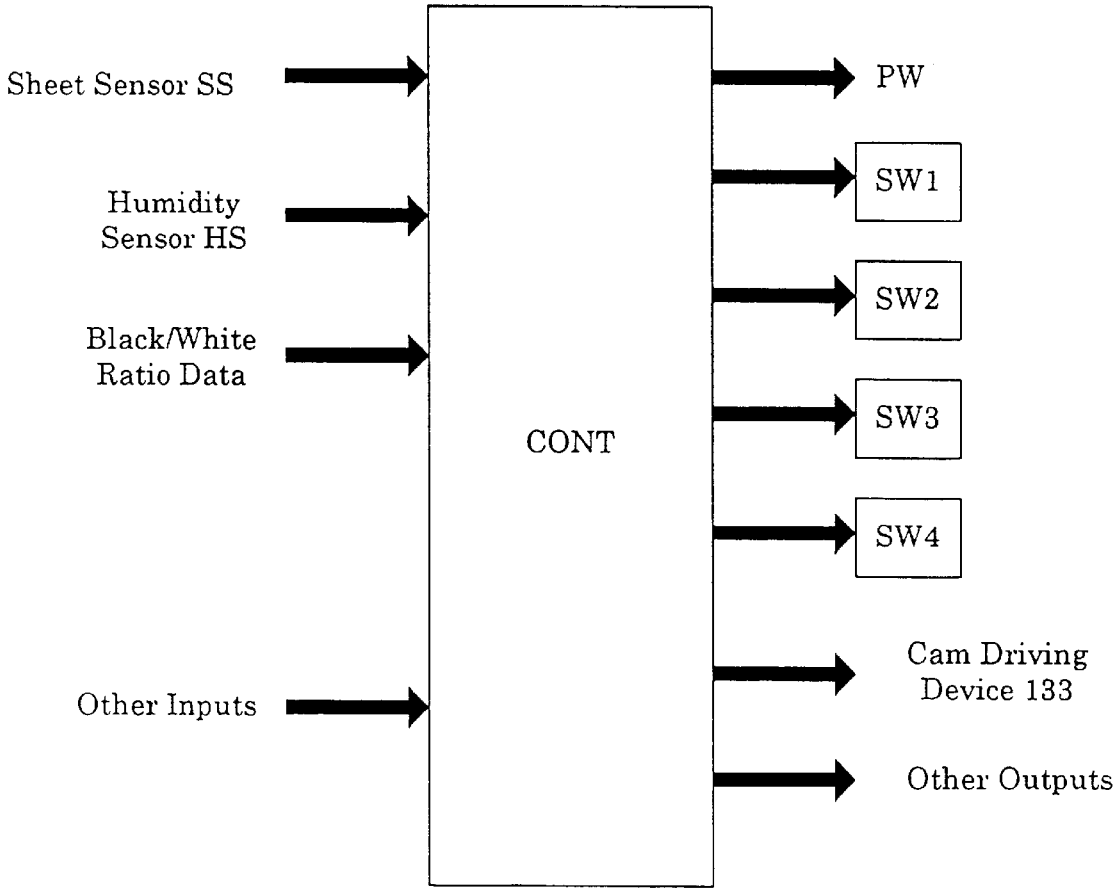
FIG. 3 is a block diagram briefly showing the control circuit of the image forming apparatus of FIG. 1.

FIG. 3 briefly shows the control circuit of the image forming apparatus.

This image forming apparatus is provided with a controller CONT which includes a microcomputer to control all operation of the apparatus; voltage application from charging power unit PW to charging member 12, and operation of switches SW1, SW2, SW3, SW4 are all accomplished via instructions from the controller CONT. The cam driving device 133 in charger 11 operates under the conditions and timing specified by the controller CONT. Other components also perform predetermined operations via instructions from the controller CONT.

This image forming apparatus inputs black-to-white (B/W) ratio data from a B/W ratio output unit (not illustrated) to the controller CONT to preview the B/W of a formed image as an essential factor in determining the timing to execute the cleaning operation. This image forming apparatus includes a sheet sensor SS and humidity sensor HS to preview the number of sheets for image formation and the ambient humidity, and the output of said sensors are input to the controller CONT as essential factors in determining the timing of the cleaning operation. Although these sensors are omitted in FIG. 1, the sheet sensor SS is disposed at a position allowing detection of the number of image formation sheets, and sensor HS is disposed at a position allowing detection of humidity.

In the aforesaid image forming apparatus, a voltage is applied from power unit PW to electrode 122 when blade 121 of charging member 12 is in a state of contact with the photosensitive member 1 as shown in FIG. 1 so as to uniformly charges the entire surface of photosensitive member 1 thereby. An electrostatic latent image corresponding to a document image is formed in the region charged by charger 11 via exposure device IE, and this latent image is developed by toner via developing device D (i.e., the latent image is rendered visible via reverse developing accomplished using negatively chargeable toner). In this developing process, switch SW3 is closed, and power unit PW3 supplies a developing bias voltage V3 to developing roller Dr. The developed image (i.e., toner image) is transferred via transfer roller Tr onto a recording member S transported thereto. In this transfer process, switch SW1 is closed, and a transfer voltage V1 is supplied to transfer roller Tr. The transfer image transferred onto the recording member S is fused onto said recording member S under heat and pressure via a fixing device (not illustrated).

After the toner image has been transferred, the residual toner remaining on the surface of photosensitive member 1 is swept along until it reaches the initial contact position X of photosensitive member 1 and charging member 12 of charger 11. The residual charge remaining on the surface of photosensitive member 1 is eliminated by eraser IL in preparation for a subsequent image forming process.

In this way charger 11 sweeps collects foreign substance such as residual toner and the like arriving at initial contact position X between the charging member 12 and photosensitive member 1 from the surface of photosensitive member 1 and collects said substance at the accumulation area Z. On the other hand, charging member 12 has a charging area Y which includes the electrode 122 on the downstream side form the initial contact area X, and charges the surface of photosensitive member 1 via discharge to said photosensitive member 1 in the charging area so as to charge the surface of the photosensitive member 1 from which the foreign substance has been removed. Accordingly, charging is accomplished without hindrance from foreign substance so as to charge the photosensitive member 1 without uneven charging which plagues conventional devices, and produces excellent and stable charging. Even if some foreign substance should escape the charging member 12 and reach the charging area Y, this foreign substance would rapidly pass this position via the movement of the surface of the photosensitive member 1 so as to have no material affect upon uniform charging.

When foreign substance accumulates at the accumulation area Z, image formation is stopped and a cleaning operation is executed to collect the accumulated foreign substance. In the cleaning operation, photosensitive member 1 is rotated and charging member 12 is retracted from photosensitive member 1 so that the accumulated foreign substance passes between the charging member 12 and photosensitive member 1 in conjunction with the rotation of said photosensitive member 1. Therefore, the foreign substance does not excessively accumulate in accumulation area Z and there is no soiling of the charging member 12 or photosensitive member 1.

During the cleaning operation, switch SW4 is closed to supply a low voltage from power unit PW4 to developing roller Dr in developing device D rather than from power unit PW3, and foreign substance such as residual toner and the like passes the charging member 12 and arrives at developing roller Dr so as to be collected in developing device D. Furthermore, in transfer device T, switch SW2 is closed to supply an opposite polarity voltage from power unit PW2 to transfer roller Tr rather than from power unit PW1, so as to prevent adhesion of foreign substance on the transfer roller Tr.

The specific sequence of the cleaning operation is discussed below with reference to the flow charts of FIGS. 4*a* and 4*b* which show the operation of the controller CONT.

Figure 4A:
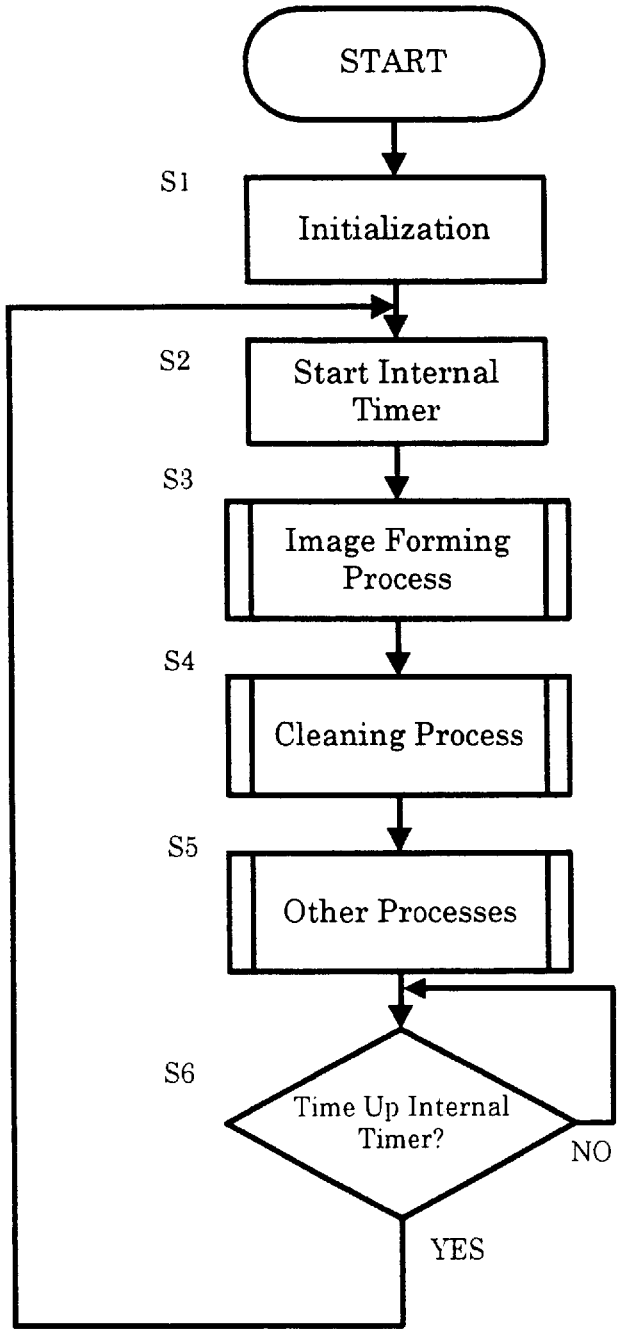
FIGS. 4*a* and 4*b* are flow charts of the control sequence executed by the control circuit of FIG. 3.
Figure 4B:
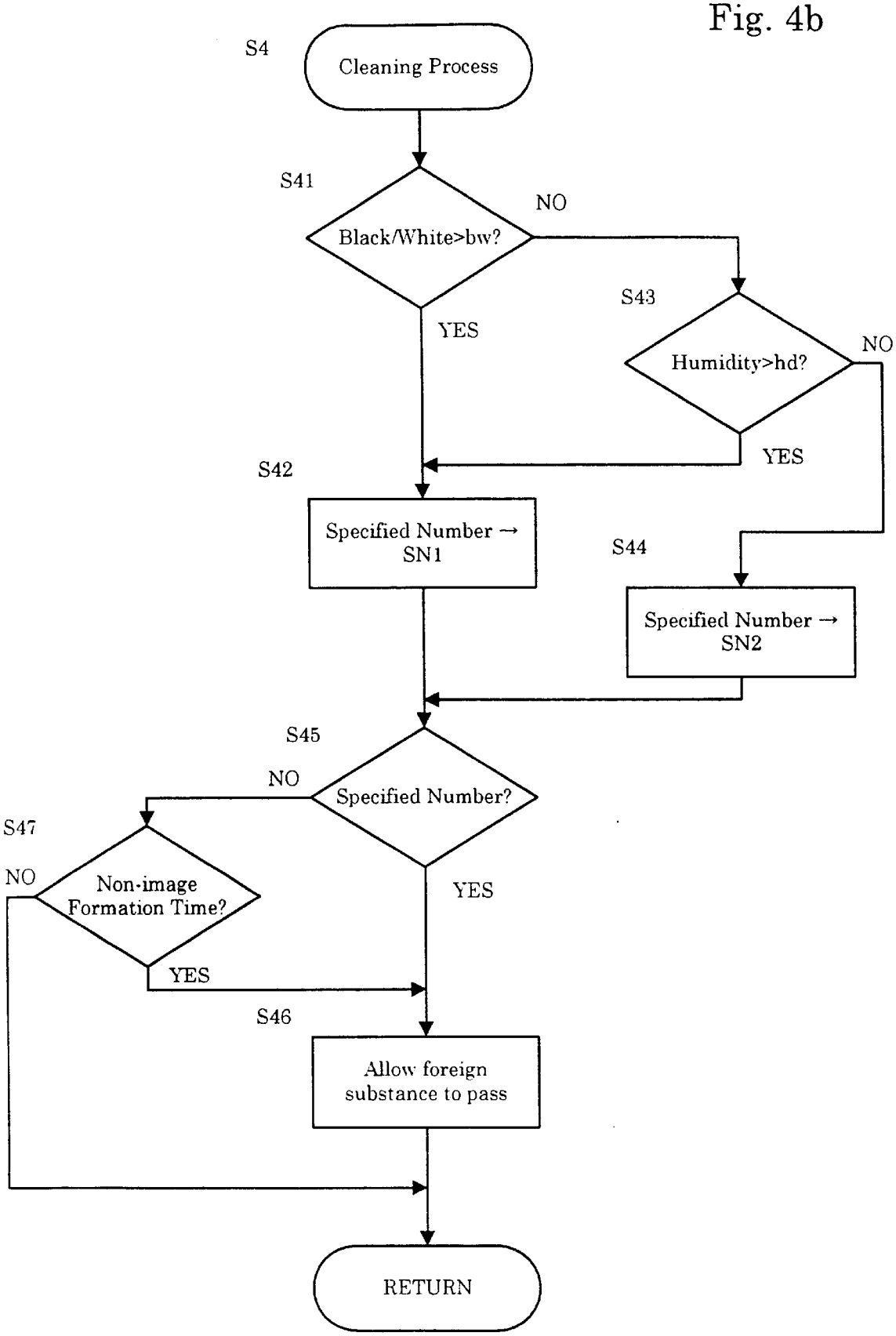

FIG. 4*a* shows the main routine of the controller operation, and FIG. 4*b* shows the subroutine of the cleaning operation.

In the main routine, initialization settings are executed (step S1), then an internal timer is started (step S2), and the image forming process (step S3), cleaning process (step S4), and other processes (step S5) are sequentially executed, the completion of the internal timer is awaited, and when the timer ends the routine returns to step S2 (step S6).

In the cleaning process (step S4), first a check is made to determine whether or not the black-to-white (B/W) ratio of the image to be formed is greater than a predetermined value bw (step S41). If the B/W ratio value is greater than the predetermined value bw, it indicates the foreign substance has passed and the specified number of image forming sheets is set in register SN1 (step S42). If the B/W ratio value is less than the predetermined value bw, a determination is made as to whether or not the ambient humidity is greater than a predetermined value hd (step S43). If the ambient humidity is greater than the predetermined value hd, it indicates the foreign substance has passed and the specified number of image forming sheets is set in register SN1 (step S42). When the ambient humidity is less than the predetermined value hd, the number of image forming sheets is set in register SN2 (>SN1) (step S44). After the specified number of image forming sheets has been set indicating the foreign substance has passed, when the number of image forming sheets SN reaches a predetermined number of sheets, image formation is stopped and the cam driving device 133 is operated in charger 11 to retract the charging member 12 from the surface of photosensitive member 1 so as to allow the accumulated foreign substance to pass. Thereafter, the routine returns to the main routine (steps S45, S46). Until the specified number of image forming sheets has been attained, the routine returns to the main routine if image formation is ongoing, and the routine returns to the main routine after executing step S46 during non-image formation time.

A cleaner may be provided to sweep residual toner from the surface of photosensitive member 1 between the transfer device T and the charger 11. In this arrangement, during cleaning, foreign substance that has accumulated by charging member 12 and has passed the charging member, will also pass the developing device D and the transfer device T and arrive at said cleaner. Therefore, in the developing device D a developing bias voltage identical to that used during image formation is supplied to developing roller Dr, and either the voltage is turned OFF to transfer roller Tr or a voltage having the same polarity as the toner is applied to transfer roller Tr. In the example shown in the drawing, the voltage may be supplied by power unit PW2.

The materials used to construct charging member 12 of charger 11 are discussed below.

The blade 121 of charging member 12 is formed of polyurethane in the current examples. The blade 121 is not limited to this material, however, and may be constructed of typical materials other than polyurethane used to construct a cleaning blade such as, for example, ethylene tetrafluoride resin, polyimide, polyester and the like.

Although the thickness of the blade 121 in the present example is 2 mm, it is not restricted to this thickness. On the other hand, when the blade is too thin, it inverts in the direction of travel of the surface of the charge-receiving member, thereby reducing its ability to stop foreign substance such as toner and the like. When the blade 121 is too thick, the charging device becomes larger. Accordingly, the blade 121 will generally have a thickness of 0.5~10 mm, and preferably 1~4 mm.

The electrode 122 of the charging member is formed of conductive material such as, for example, metals such as chrome, copper, platinum, tungsten, aluminum, indium, titanium and the like, ITO, carbon or like conductive materials. The electrode 122 of the charging member may be formed on the blade by means such as spattering or patterning by photoetching. Furthermore, thin strip-like electrodes may be adhered to the blade, or various other forming methods may be used.

It is desirable that the electrode is semiconductive to accomplish stable continuous discharge.

At least the surface of the discharge tip of the electrode may be coated by an inorganic thin film of metal oxide, diamond-like carbon film or the like so that the electrode formed on the blade is capable of stable discharge over a long time period.

The material and thickness of the aforesaid blade, and the material used to form the electrode may include the materials and dimensions of other charging members of charger described later.

Figure 5:
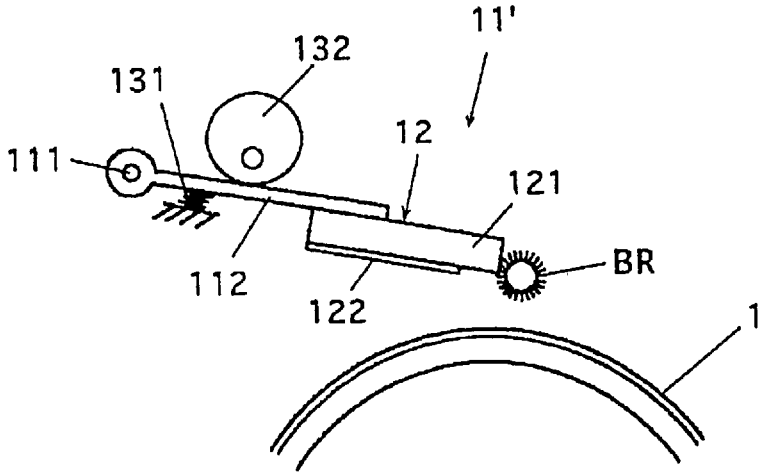
FIG. 5 is a side view of another charger.

FIG. 5 shows the construction of another charger 11' which may be substituted for the charger 11 in the image forming apparatus shown in FIG. 1. charger 11' differs from the charger 11 of FIG. 1 in that a brush roller BR is used. Brush roller BR is disposed at a position so as to contact the tip of blade 121 when charging member 12 is retracted form the surface of photosensitive member 1, so as to sweep the tip of said blade 121 as brush BR is driven in rotation by a motor.

Figure 6:
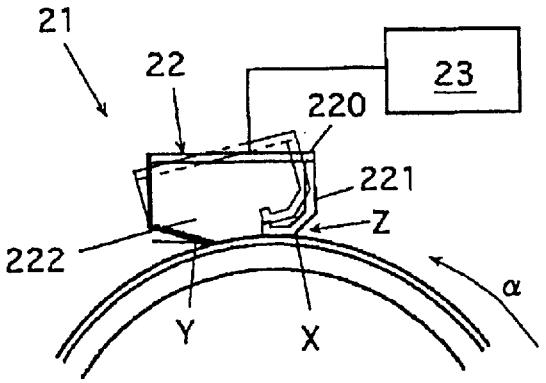
FIG. 6 is a side view of still another charger.

FIG. 6 shows the construction of another charger 21 which can be substituted for the charger 11 in the image forming apparatus of FIG. 1. The charging member 22 in charger 21 comprises a semiconductive member 222 and insulated member 221 mounted on a support plate 220. In charging member 222, insulated member 221 contacts the charge-receiving member 1, to form a foreign substance accumulation area Z on the upstream side of the initial contact position X between insulated member 221 and charge-receiving member 1. Semiconductive member 222 functions as a charging area (discharge area) Y on the downstream side from the initial contact position X. A voltage is supplied to semiconductive member 222 when charging. This voltage induces a discharge from said semiconductive member 222 that charges the surface of the charge-receiving member 1. Discharge does not occur at the foreign substance accumulation area Z or the initial contact position X between insulated member 221 and the charge-receiving member 1.

A foreign substance passing device 23 which uses a solenoid combined with the spring and cam shown in FIG. 1 and is attached to the charging member 22. The charging member 22 can be retracted from the charge-receiving member 1 to allow foreign substance accumulated in accumulation area Z to pass between charging member 22 and charge-receiving member 1 so as to collect the foreign substance that has accumulated in accumulation area Z.

Figure 7:
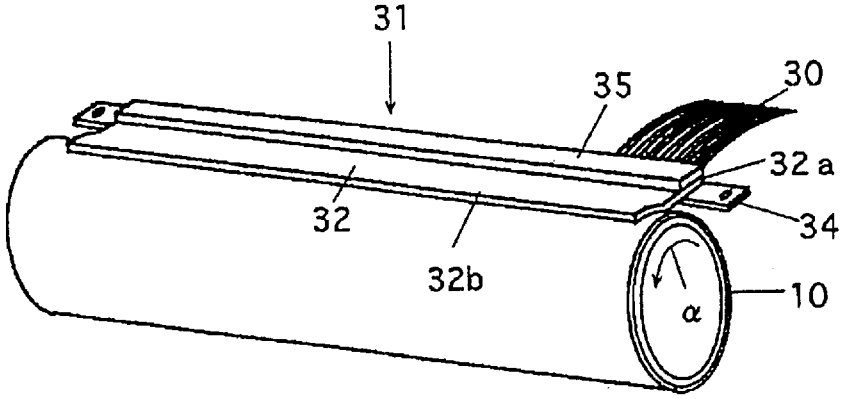
FIG. 7 is a perspective view of still another charger.
Figure 8:
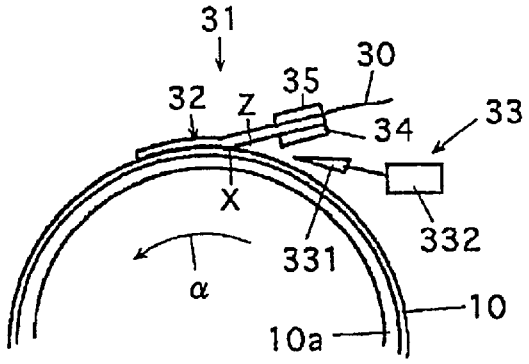
FIG. 8 is a side view of a charge-receiving member and the charger of FIG. 7.

FIGS. 7 and 8 show the construction of a charger 31 used as a printhead of an electrostatic recording device that directly forms an electrostatic latent image on the surface of an image-bearing member 10, unlike the image forming apparatus of FIG. 1.

Charger 31 is provided with a flexible sheet-like charging member 32. Charging member 32 is provided with a width in the transverse direction to the direction of travel α of the surface of the image-bearing member (charge-receiving member) 10 of the image forming apparatus. On the upstream side in the direction of travel α of the surface of the image-bearing member 10, the edge 32*a* of the charging member 32 is supported from below by support members 34 and 35, and the contact area 32*b* from the center of charging member 31 to either edge comes into contact along the surface of the image-bearing member 10 while in a free state.

Image-bearing member (charge-receiving member) 10 comprises a dielectric layer applied over the surface of a semiconductive support drum 10*a*. The dielectric layer attains a suitable surface potential via discharge from the charger 31 without insulation damage, and is capable of supporting the surface potential throughout the developing process, then discharges the surface potential throughout repeated developing processes. Although a drum-like member is used in the present example, other configurations are possible. When a photoconductive layer is substituted for the aforesaid dielectric layer, the surface can be readily and repeatedly discharged via optical exposure of the entire surface.

In the examples described herein, the contact portion 32*b* on the downstream side of charging member 32 contacts the surface of image-bearing member 10. The edge of said contact portion 32*b* on the upstream side in the direction of travel α of the surface of the image-bearing member forms an initial contact position X relative to the image-bearing member, and a foreign substance accumulation area Z is formed on the upstream side therefrom.

As shown in FIG. 8, charger 31 is also provided with a foreign substance passage device 33 to allow foreign substance accumulated at the accumulation area Z to pass between the charging member 32 and the image-bearing member 10. This passage device 33 includes a contact member 331 which can be inserted to the underside of charging member 32 when the bottom surface of charging member 32 is in contact with the image-bearing member and can be retracted therefrom, and a drive unit 332 to accomplish the reciprocating operation of said member 331. When contact member 331 is inserted to the underside of charging member 32, foreign substance adhered to the underside of the charging member 32 is swept therefrom, and when said charging member is retracted from the image-bearing member 10, the foreign substance passes on the under side of charging member 32.

Figure 9:
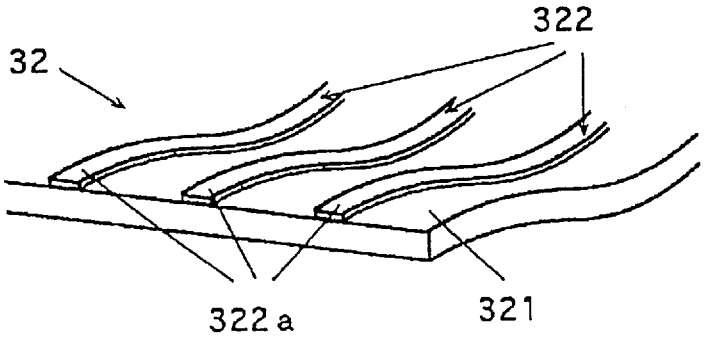
FIG. 9 is a perspective view of part of the charging member and charger of FIG. 7.

As shown in FIG. 9, charging member 32 is provided with a plurality of flexible discharge electrodes 322 on a flexible insulated member 321, such that an initial contact area X is formed when flexible insulated member 321 contacts the image-bearing member (charge-receiving member) 10. The flexible electrodes 322 extend in the direction of travel α of the surface of the image-bearing member, and are arranged in plurality in mutually parallel array. These electrodes 322 may be connected to a discharge power unit via signal cable 30 so as to be usable as recording electrodes.

To achieve sufficient discharge from the flexible electrodes 322, at least the part of the flexible insulated member 321 that contacts the edge 322*a* of the electrodes 322 shall have a thickness of about 5~1,000 μm, and preferably a thickness of about 5~200 μm to achieve adequate responsiveness to the minute irregularities and undulations of the surface of image-bearing member 10, depending on the material and Young's modulus of the flexible insulated member. The thickness of the aforesaid part will maintain a constant distance between the image-bearing member and the tip 322*a* of the flexible electrodes 322 which discharge when a discharge voltage is applied. The thickness of this part, therefore, must be uniform to a degree that does not markedly affect discharge.

Ethylene tetrafluoride resin, urethane rubber, polyimide, polyester and the like may be used as materials to construct the flexible insulated member 321, although the member is not limited to said materials.

The area of contact between the flexible insulated member 321 and the image-bearing member 10 is desirably formed of material having excellent wear resistance, or material having a small friction coefficient relative to the image-bearing member.

Examples of usable materials to form the flexible electrodes 322 include metals such as chrome, copper, gold, platinum, tungsten, aluminum, indium, titanium and the like, and conductive materials such as ITO, carbon and the like. The flexible electrodes 322 may be formed on the flexible insulated member via means such as patterning via photoetching, and spattering.

At least the surface of the discharge tip of the electrode may be coated by an inorganic thin film of metal oxide, diamond-like carbon film or the like so that the electrode formed on the blade is capable of stable discharge over a long time period. It is desirable that such a coating is within a range that will not produce cracks to assure flexibility of the insulated member and the electrode.

At least the tip of the flexible electrode may be coated with a protective overlayer having a higher resistance than the flexible electrode to prevent leaks between adjacent electrodes and maintain stable discharge during high humidity conditions.

Providing that at least the tips of the flexible electrodes 322 have a semiconductivity of about $10^1$~$10^8$ Ωcm is effective in preventing abnormal dot discharge and leaks between adjacent electrodes, and maintaining stable discharge under high humidity conditions. In the case of semiconductive electrode tips, when the resistance is too high, an excessively high voltage drive voltage is required, and when the length of the semiconductive parts differ, an undesirable discharge differential results.

The degree of binding between the charging member 32 and the image-bearing member 10 should be sufficient to collect foreign substance such as residual toner after transfer in the accumulation area Z.

A first method for achieving this is to triboelectrically charge the charging member 32 and image-bearing member 10 to produce an electrostatic adhesion.

Figure 10:
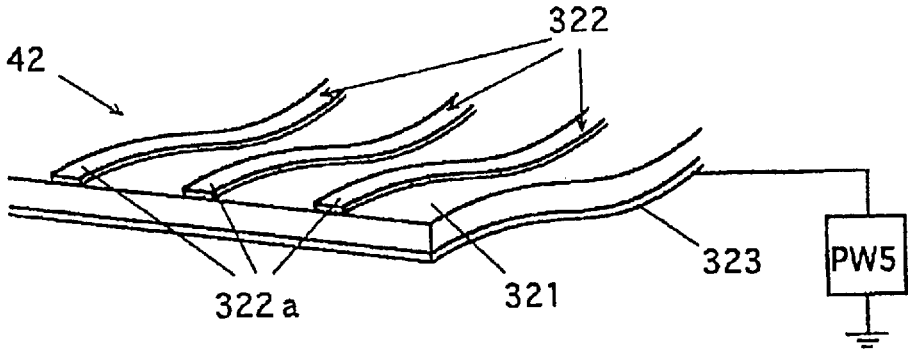
FIG. 10 is a perspective view of a charging member that can be substituted for the charging member of FIG. 9.

A second method uses the charging method 42 shown in FIG. 10. Charging member 42 is provided with a semiconductive member 323 on the surface of flexible insulated member 321 on the side opposite the flexible electrode, and achieves adhesion by means of a voltage applied when the semiconductive member makes contact with the image-bearing member.

As shown in FIG. 10, the semiconductive member may be provided on the surface of one side of flexible insulated member 321, or may be provided only at the discharge tips 322*a* of the flexible electrodes 322 that must maintain a uniform distance, or only at said tip and vicinity thereof.

The material used to form the semiconductive member may be a mixture of conductive materials mixed with ethylene tetrafluoride resin, urethane rubber, polyimide, polyester and the like, but is not limited to these materials. Methods for forming the semiconductive member include fluid application, spattering and the like, but is not limited to these methods. Since the semiconductive member rubs against the image-bearing member, it is desirable from the perspective of torque on the image-bearing member that said semiconductive member is formed of material having excellent wear resistance, and has a low friction coefficient relative to the image-bearing member. When a cleaning device is provided to clean the image-bearing member, it is desirable that the semiconductive member is formed of material having excellent release characteristics relative to toner and the like so as to prevent fusion of said toner on the semiconductive member when such residual material remaining after developing arrives at the charger.

A suitable resistance value for the semiconductive member is about $10^1$~$10^8$ Ωcm.

A voltage is applied to the semiconductive member by a drive power unit. FIG. 10 shows an example of a voltage supplied by a power unit PW5 to the semiconductive member 323 during image formation.

It is desirable that the voltage value supplied to the semiconductive member is such as to not cause charging of the image-bearing member by the semiconductive member. Depending on the material and resistance value of the semiconductive member, the image-bearing member may not be charged if the difference in voltage value supplied to the semiconductive member and the potential of the image-bearing member is less than about 550 V. If the potential of the image-bearing member is 0 V, a suitable voltage applied to the semiconductive member will be about −550–550 V. When a voltage is supplied to the semiconductive member, the semiconductive member is adhered to the image-bearing member by electrostatic force. As a result, the discharge tip of the flexible electrode and the parts in the vicinity thereof maintain a uniform discharge distance relative to the image-bearing member. This electrostatic adhesion effectively prevents foreign substance such as residual toner after transfer and paper debris from the recording sheets from migrating from the initial contact position X of the charging member toward the image-bearing member.

An electret material may be substituted for the aforesaid semiconductive material. In this instance, a voltage application is omitted.

Figure 11:
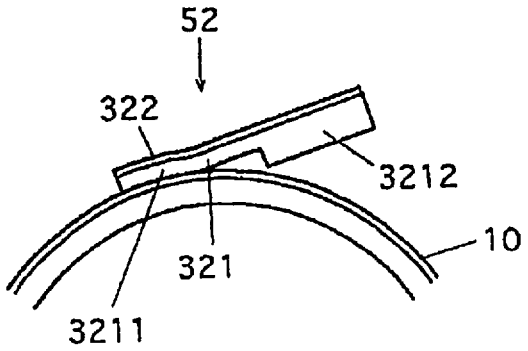
FIG. 11 is a side view of another charging member.
Figure 12:
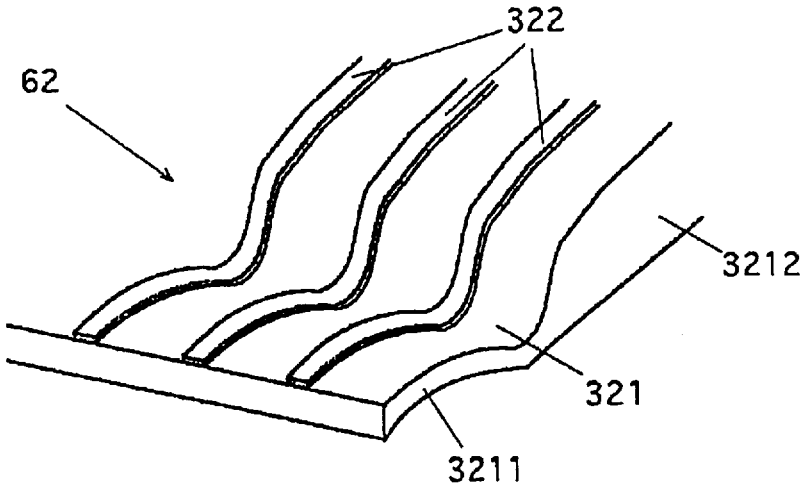
FIG. 12 is a perspective view of still another charging member.

A third method uses charging members constructed as shown in FIGS. 11 and 12. The charging members 52 and 62 shown in FIGS. 11 and 12, respectively, provide a contact part 3211 of flexible insulated member 321 that contacts the image-bearing member 10, said contact part 3211 having a thickness of for example about 5~1,000 μm, and a support part 3212 on the upstream side supported by a support member and which is thicker by several hundred microns to several mm than said contact part 3211. This arrangement increases the pressing force of charging members 52 and 62 toward the image-bearing member, and increases the foreign substance stopping power at the initial contact position relative to the image-bearing member.

Figure 13:
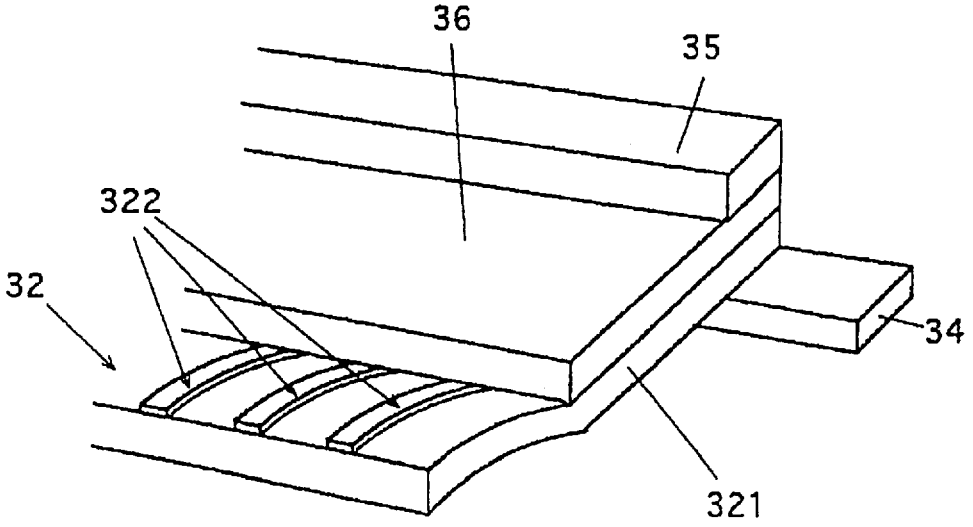
FIG. 13 is a perspective view of still another charging member.

In the example shown in FIG. 13, a flexible member 36 abuts the flexible insulated member 321 of charging member 32 at an area near area supported by support members 34 and 35, such that said flexible member 36 and flexible insulated member 321 are interposed between said support members 34 and 35. According to this arrangement, flexible insulated member 321 is pressed so as to increase the pressure contact between said flexible insulated member 321 and the image-bearing member with similar effectiveness.

Figure 14:
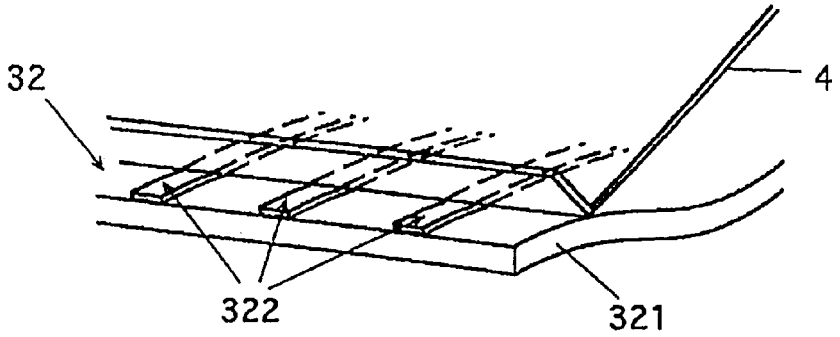
FIG. 14 is a perspective view of still another charging device.

In the example shown in FIG. 14, the curved portion of a pressing member 4 which is curved in an L-shape presses against the flexible insulated member 321 of charging member 32 near the downstream edge, so as to maintain a uniform distance between the flexible electrodes 322 and the image-bearing member, as well as improve the pressure contact between the charging member 32 and the image-bearing member and increase the power of stopping foreign substance such as toner.

Figure 15:
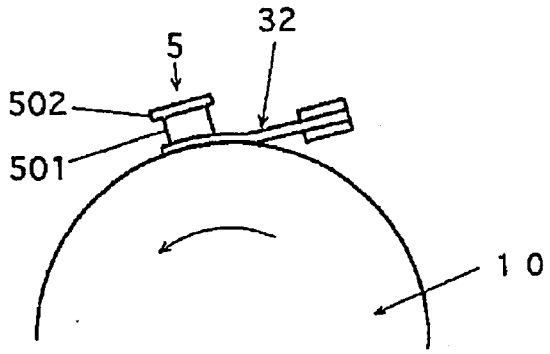
FIG. 15 is a perspective view of still another charging device.

In the example shown in FIG. 15, the vicinity of the downstream edge of charging member 32 is pressed by a pressure member 5, so as to maintain a uniform distance between the flexible electrodes 322 and the image-bearing member, and this arrangement is similar in effectiveness to the arrangement shown in FIG. 13. Pressure member 5 comprises a pressure body 501 and a support member 502 to support said pressure body. Pressure body 501 may be formed of expanded urethane or expanded silicone rubber or the like so as to be capable of exerting sufficient pressure poser and adequate tracking characteristics relative to the image-bearing member.

A fourth method provides a relatively higher hardness of the charging member 32 on the upstream side from the initial contact position X with image-bearing member 10 than on the downstream side so as to achieve adequate pressing force. In this instance, normally the insulated member 321 may be made harder on the upstream side.

The aforesaid methods prevent foreign substance such as toner from entering the charging region.

Figure 16:
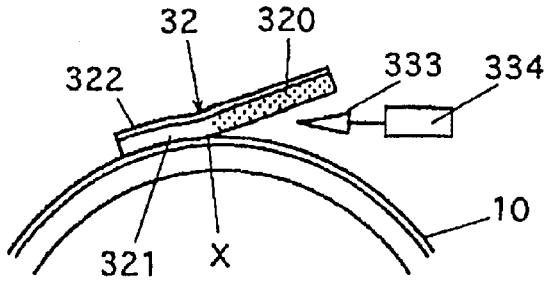
FIG. 16 is a perspective view of still another charging device.

Reference number 333 in FIG. 16 refers to a scraper which operates similarly to the contact member 331 of FIG. 8, and reference number 334 refers to the drive unit for said scraper.

Figure 17:
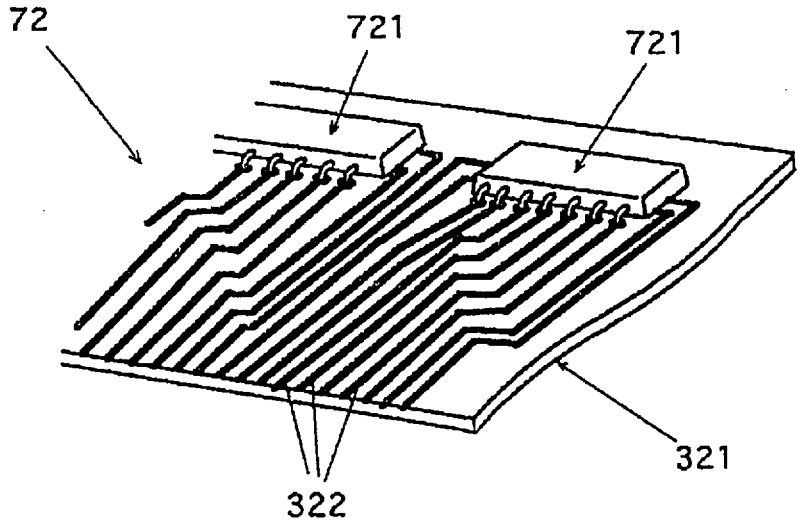
FIG. 17 is a perspective view of still another charging device.

FIG. 17 shows another example of a charging member suitable for the aforesaid charging device. This charging member 72 has an integrated circuit (IC) drive unit 721 mounted directly on a flexible insulated member 321, which directly supplied a voltage to the flexible electrodes 322. This construction is compact, and reduces the number of signal cables.

Figure 18:
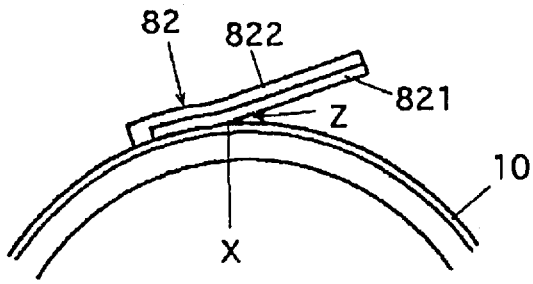
FIG. 18 is a perspective view of still another charging device.

FIG. 18 shows still another example of a charging member suitable for the aforesaid charger. Charging member 82 comprises a flexible insulated member 821 and a flexible semiconductive electrode 822, and the initial contact position X of charging member 82 relative to image-bearing member 10 is in the area of flexible insulated member 821. Accordingly, discharge does not occur at the initial contact position X nor upstream therefrom; discharge occurs at the tip of the flexible semiconductive electrode 822 on the downstream side from the initial contact position X. A foreign substance accumulation area Z is formed in the vicinity of the initial contact position X. This contact member 82 may be provided with a foreign substance passage device including a contact member or scraper as shown in FIGS. 8 and 16.

Figure 19:
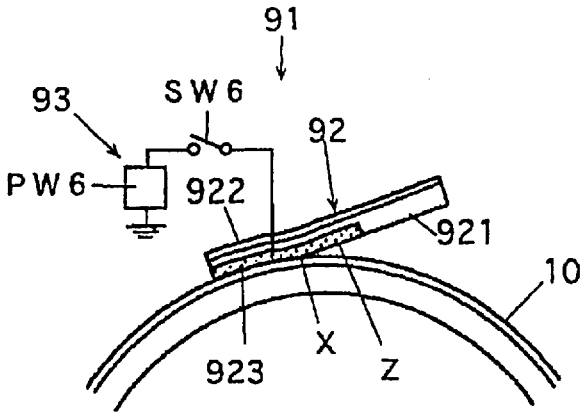
FIG. 19 is a perspective view of still another charging device.

FIG. 19 shows part of yet another example of a charging device. The charging member 92 in charger 91 is similar to the charging member 42 shown in FIG. 10. A flexible discharge electrode 922 is provided on flexible insulated member 921, and a semiconductive layer 923 is provided on part of said flexible insulated member 922 including the downstream edge thereof, such that part of said semiconductive member 923 contacts the image-bearing member 10 to form the initial contact position X. A voltage to pass foreign substance is supplied from the power unit PW6 to the semiconductive member 923 via switch SW6. That is, the foreign substance passage device comprises the semiconductive member 923 in contact with the image-bearing member 10, and a means to apply a voltage to said semiconductive member 923. The power unit PW6 supplies an electric field to produce a weak and mutually attractive adhesion force between the charging member 92 and the image-bearing member 10, or a voltage to generate a mutually repulsive electric field. When this voltage is applied, foreign substance accumulated in accumulation area Z passes between the charging member 92 and the image-bearing member 10, and is collected. For example, power unit PW6 may apply a voltage to semiconductive member 923 which has equal potential to the potential of image-bearing member 10. In this instance, a weak adhesion force is produce between the charging member 92 and the image-bearing member 10 by the application of a voltage of equal potential. Power unit PW6 may supply an alternative current (AC) voltage. When an AC voltage is applied, the charging member 92 oscillates to allow foreign substance to pass.

In the various chargers described above, it is desirable that the contact angle of the charging member relative to the charge-receiving member at the initial contact position relative to the charge-receiving member is 20 degrees or higher but less than 90 degrees, preferably 30 degrees or higher but less than 85 degrees, and more preferably 45 degrees and higher but less than 85 degrees to reliably sweep the foreign substance from the charge-receiving member via the charging member. The contact pressure between the charging member and the charge-receiving member is desirably 0.3 $g/mm^2$ or higher but less than 6 $g/mm^2$, and preferably 0.5 $g/mm^2$ or higher but less than 4 $g/mm^2$, and more preferably 1 $g/mm^2$ or higher but less than 3 $g/mm^2$.

The aforesaid embodiments are suitable for chargers in image forming apparatuses, it is to be understood that these image forming apparatuses include copiers that form developed images such as toner images n paper, printers, and facsimile machines, as well as display devices that directly display visible images such as toner images.

Although the present invention has been fully described by way of examples with reference to the accompanying drawings, it is to be noted that various changes and modification will be apparent to those skilled in the art. Therefore, unless otherwise such changes and modifications depart from the scope of the present invention, they should be construed as being included therein.

What is claimed is:

1. A contact-type charger comprising:

a charging member disposed so as to contact the surface of a charge-receiving member, wherein said charge-receiving member moves relative to said charging member, such that the charging member removes foreign substance present on the charge-receiving member on the upstream side in the direction of travel of the charge-receiving member at the contact region with the charging member, and charges said charge-receiving member in the area from which said foreign substance has been removed at the contact region on the downstream side of the charge-receiving member in the direction of travel of the charge-receiving member; and passing means for making the removed foreign substance pass by said charging member in conjunction with the movement of the charge-receiving member, wherein a discharge voltage is applied between said charging member and the charge-receiving member on the downstream side of an initial contact position in the travel direction, said initial contact position being a location of initial contact between the charging member and the charge receiving member in view of the travel direction.

2. The contact-type charger as claimed in claim 1, wherein the discharge voltage is not applied between said charging member and the charge-receiving member at said initial contact position.

3. The contact-type charger as claimed in claim 1, wherein said charging member includes a discharge electrode which the discharge voltage is applied on and an insulated member between said discharge electrode and said charge-receiving member.

4. The contact-type charger as claimed in claim 3, wherein said discharge electrode has a plurality of tips.

5. The contact-type charger as claimed in claim 1, wherein said passing means includes a mechanism which moves the charging means between a operative position where the charging member is in contact with the charge-receiving member and a non-operative position where the charging member is out of contact with the charge-receiving position.

6. A contact-type charger comprising:

a charging member disposed so as to contact the surface of a charge-receiving member, wherein said charge-receiving member moves relative to said charging member, such that the charging member removes foreign substance present on the charge-receiving member on the upstream side in the direction of travel of the charge-receiving member at the contact region with the charging member, and charges said charge-receiving member in the area from which said foreign substance has been removed at the contact region on the downstream side of the charge-receiving member in the direction of travel of the charge-receiving member; and passing means for making the removed foreign substance pass by said charging member in conjunction with the movement of the charge-receiving member, wherein said charging member includes a flexible electrode which discharge voltage is applied on and an intermediate member which is disposed between said flexible electrode and the charge-receiving member.

7. The contact-type charger as claimed in claim 6, wherein said intermediate member is a semiconductive material.

8. The contact-type charger as claimed in claim 7, wherein said passing means includes a power unit which supplies an electric field to produce a weak and mutually attractive adhesion force between the charging member and the charge-receiving member or a mutually repulsive electric field.

9. The contact-type charger as claimed in claim 8, wherein said power unit applies a voltage to said intermediate member which has equal potential to the potential of the charge receiving member.

10. The contact-type charger as claimed in claim 8, wherein said power unit applies an alternative current voltage to said intermediate member so that the charging member oscillates to allow foreign substance to pass.

11. The contact-type charger as claimed in claim 6, wherein said intermediate member is an electret material.

12. A image forming apparatus comprising:

a charge-receiving member on which images is formed;

a charger including, a charging member disposed so as to contact the surface of said charge-receiving member, wherein said charge-receiving member moves relative to said charging member, such that the charging member removes foreign substance present on the charge-receiving member on the upstream side in the direction of travel of the charge-receiving member at the contact region with the charging member, and charges said charge-receiving member in the area from which said foreign substance has been removed at the contact region on the downstream side of the charge-receiving member in the direction of travel of the charge-receiving member, and passing means for making the removed foreign substance pass by said charging member in conjunction with the movement of the charge-receiving member; and a controller which controls an operation of said passing means, wherein said controller energizes said passing means every predetermined number of image forming operations to make the removed foreign substance pass by said charging member, and said controller changes said predetermined number in accordance with black to white ratio of images formed on the charge-receiving member.

13. The image forming apparatus as claimed in claim 12, wherein said controller energizes said passing means during a non-image forming period to make the removed foreign substance pass by said charging member.

14. The image forming apparatus as claimed in claim 12, further comprising, a cleaner disposed on downstream side of the charger with respect to the travel direction, said cleaner removing the foreign substance which passes the charging member from the surface of the charge-receiving member.

15. The image forming apparatus as claimed in claim 14, wherein said cleaner includes a developing roller which develops the images on the charge-receiving member with developer.

16. The image forming apparatus as claimed in claim 14, wherein said cleaner includes a transfer roller which transfers the images from the charge-receiving member to a sheet.

17. An image forming apparatus comprising:

a charge-receiving member on which images is formed;

a charger including, a charging member disposed so as to contact the surface of said charge-receiving member, wherein said charge-receiving member moves relative to said charging member, such that the charging member removes foreign substance present on the charge-receiving member on the upstream side in the direction of travel of the charge-receiving member at the contact region with the charging member, and charges said charge-receiving member in the area from which said foreign substance has been removed at the contact region on the downstream side of the charge-receiving member in the direction of travel of the charge-receiving member, and passing means for making the removed foreign substance pass by said charging member in conjunction with the movement of the charge-receiving member; and a controller which controls an operation of said passing means, wherein said controller energizes said passing means every predetermined number of image forming operations to make the removed foreign substance pass by said charging member, and said controller changes said predetermined number in accordance with ambient humidity.

18. The image forming apparatus as claimed in claim 17, further comprising, a cleaner disposed on downstream side of the charger with respect to the travel direction, said cleaner removing the foreign substance which passes the charging member from the surface of the charge-receiving member.

19. The image forming apparatus as claimed in claim 18, wherein said cleaner includes a developing roller which develops the images on the charge-receiving member with developer.

20. The image forming apparatus as claimed in claim 18, wherein said cleaner includes a transfer roller which transfers the images on the charge-receiving member to a sheet.

* * * * *

UNITED STATES PATENT AND TRADEMARK OFFICE

CERTIFICATE OF CORRECTION

PATENT NO. : 5,873,013

DATED : 02-16-99

INVENTOR(S) : Kouji MATSUSHITA, Futoshi OKAZAKI

It is certified that error appears in the above-identified patent and that said Letters Patent is hereby corrected as shown below:

Col. 16, Line 3: Change "on" to --from--.

Cover Page, under Priority Data: Change "8-359180" to --8-359190--.

Signed and Sealed this

Tenth Day of August, 1999

*Attest:*

*Attesting Officer*

Q. TODD DICKINSON

*Acting Commissioner of Patents and Trademarks*